US011865418B2

(12) United States Patent
Lambeth et al.

(10) Patent No.: US 11,865,418 B2
(45) Date of Patent: Jan. 9, 2024

(54) GOLF CLUB HEAD

(71) Applicant: SUMITOMO RUBBER INDUSTRIES, LTD., Kobe (JP)

(72) Inventors: Jacob Lambeth, Irvine, CA (US); Phillip C. Seagram, Long Beach, CA (US); Dustin Brekke, Fountain Valley, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/458,820

(22) Filed: Jul. 1, 2019

(65) Prior Publication Data

US 2021/0001190 A1 Jan. 7, 2021

(51) Int. Cl.
*A63B 53/04* (2015.01)

(52) U.S. Cl.
CPC ..... *A63B 53/0487* (2013.01); *A63B 53/0437* (2020.08); *A63B 53/0441* (2020.08); *A63B 2053/0491* (2013.01)

(58) Field of Classification Search
CPC ..... A63B 53/0487; A63B 2053/0437; A63B 2053/0441; A63B 2053/0491; A63B 53/0441; A63B 53/0437; A63B 53/0491
USPC ..... 473/340
See application file for complete search history.

(56) References Cited

U.S. PATENT DOCUMENTS

| | | | | |
|---|---|---|---|---|
| 3,556,532 | A * | 1/1971 | Ballmer | A63B 53/04 473/332 |
| 4,921,253 | A * | 5/1990 | Tesori | A63B 53/0487 473/341 |
| 7,326,128 | B2 * | 2/2008 | Cole | A63B 53/0487 473/335 |
| D565,137 | S * | 3/2008 | Oldknow | D21/736 |
| 9,604,108 | B1 * | 3/2017 | Dunnell | A63B 60/02 |
| 10,350,469 | B2 * | 7/2019 | Serrano | A63B 60/00 |
| 2003/0013546 | A1 * | 1/2003 | Bradford | A63B 60/02 473/341 |
| 2004/0110574 | A1 * | 6/2004 | Green | A63B 60/02 473/340 |
| 2004/0214659 | A1 * | 10/2004 | Lindsay | A63B 53/0487 473/340 |
| 2005/0215346 | A1 * | 9/2005 | Iwade | A63B 60/00 473/313 |

(Continued)

OTHER PUBLICATIONS

"Sacks Parente Putters Seek Perfection", Golf Tips Magazine. Feb. 19, 2019. <https://www.golftipsmag.com/equipment/putters/sacks-parente-putters-seek-perfections/>. [Retrieved Jun. 15, 2021].

*Primary Examiner* — Michael D Dennis
(74) *Attorney, Agent, or Firm* — Oliff PLC

(57) ABSTRACT

A putter-type golf club head, when oriented in a reference position, includes a main body, a weight insert, a center of gravity CG with a center of gravity depth CGD, a golf club head length L from a forwardmost extent of the golf club head to its rearwardmost extent, and a ratio of CGD/L no more than 0.30. The main body includes a front portion having a face defining a face plane, a rear portion extending rearwardly from the front portion, a heel, and a toe opposite the heel. The weight insert, which is denser than the main body, includes an insert CG that is located rearwardly from the face plane by a distance no greater than 1.0 cm.

20 Claims, 11 Drawing Sheets

(56) References Cited

U.S. PATENT DOCUMENTS

| | | | | |
|---|---|---|---|---|
| 2007/0191137 | A1* | 8/2007 | Nishino | A63B 53/04 473/340 |
| 2009/0149274 | A1* | 6/2009 | Rollinson | A63B 53/0487 473/340 |
| 2010/0160062 | A1* | 6/2010 | Teramoto | A63B 60/42 473/409 |
| 2012/0064992 | A1* | 3/2012 | Franklin | A63B 53/0487 473/340 |
| 2017/0296886 | A1* | 10/2017 | Abbott | A63B 53/0487 |
| 2020/0398119 | A1* | 12/2020 | Parente | A63B 53/04 |

* cited by examiner

GOLF CLUB HEAD

BACKGROUND

Success in putting, an essential aspect of the game of golf, requires careful directional alignment and speed judgment. Known putters have an ideal impact location within which is it necessary to contact the ball during putting to accurately putt.

SUMMARY

Hitting a golf shot heelward (at a location toward the heel on a face of the putter) or toeward (at a location toward the toe of the putter on the face of the putter) from a putter's ideal impact location on the face introduces an azimuthal component to the shot's trajectory, leading to the shot being missed left or right of the target. The azimuth angle of a putt that is hit outside of the ideal impact location can be minimized by manipulating the putter head's mass properties, but this type of manipulation usually comes at the cost of aesthetics, ball speed control, and the like.

Exemplary embodiments of the broad inventive principles described herein provide a putter-type golf club head that reduces shot dispersion (i.e., reduces the azimuth angle of a putt that is hit outside of the ideal impact location) without compromising the golf club head's feel upon impact with a golf ball or appearance.

In one or more exemplary embodiments, a putter-type golf club head, when oriented in a reference position, includes a main body, a weight insert, a center of gravity CG with a center of gravity depth CGD, a golf club head length L from a forwardmost extent of the golf club head to its rearwardmost extent, and a ratio of CGD/L no more than 0.30. The main body includes a front portion having a face defining a face plane, a rear portion extending rearwardly from the front portion, a heel, and a toe opposite the heel. The weight insert, which is denser than the main body, includes an insert CG that is located rearwardly from the face plane by a distance no greater than 1.0 cm.

In one or more exemplary embodiments, the weight insert includes a heel insert and a toe insert, which are received in a heel recess and a toe insert, respectively, of the face. The weight insert has a density and a mass such that the CG of the golf club head is close to the face plane. Additionally, the heel insert has a mass that is less than a mass of the toe insert.

According to one or more exemplary embodiments, a putter-type golf club head, when oriented in a reference position, includes a main body, a heel insert, a toe insert, and a CG. The main body includes a face defining a face plane, a main body length L, a heel, and a toe opposite the heel. The heel insert and the toe insert are respectively received in a toe recess and a heel recess.

In one or more exemplary embodiments, the toe and heel inserts each have a forward surface that is substantially coplanar with the face plane. The toe insert has a greater mass than the heel insert.

A putter-type golf club head having a CG close to its face (e.g., a golf club head with a CGD/L no more than 0.30) as disclosed herein provides numerous performance benefits. As explained in more detail below, off-center golf shots (i.e., where a golf ball is struck in a toeward or heelward direction away from the ideal impact location) have significantly reduced azimuth angles, which results in decreased shot dispersion. Additionally, providing a high density weight insert in a recess of the face allows the CG to be positioned near the face without compromising the appearance of a traditional putter, which can be important to a golfer's confidence.

In one or more embodiments, a golf club head, when oriented in a reference position, includes a CGD/L ratio of no more than 0.30 and a face having a plurality of grooves that vary in one or more of depth, width, and pitch outward from a face center. The plurality of grooves may vary from the face center towards the heel and toe. In one or more embodiments, each of the plurality of grooves is curvilinear. Additionally, or alternatively, the plurality of grooves may vary from the face center towards one or both of a topline and a sole.

Advantageously, shots hit with a putter having a face with groove-to-groove variation such that groove depth decreases laterally away from the face center have more consistent ball speeds on off-center shots than shots hit with uniform grooves or no grooves. Similarly, shots hit with a putter having a face with groove-to-groove variation such that groove density decreases away from the face center have more consistent ball speeds on off-center shots. Groove-to-groove variation from the face center towards one of the topline or the sole results in ball speed normalization on putts hit high or low on the face.

In one or more embodiments, a golf club head includes a CGD/L ratio of no more than 0.30 and a face having a plurality of grooves with groove profile that is designed to match mass properties of the golf club head. For example, in one embodiment, the pitch (i.e., groove-to-groove spacing) and the depth of the plurality of grooves is varied so as to be optimized to the golf club head's moment of inertia (MOI) about a vertical axis through the head's center of gravity.

Aspects of the various exemplary embodiments described herein may be implemented individually or in various combinations.

These and other features and advantages of the golf club heads described herein in its various aspects and demonstrated by one or more of the various examples will be apparent after consideration of the ensuing description, the accompanying drawings, and the appended claims.

DESCRIPTION

Representative examples of one or more novel and nonobvious aspects and features of a putter-type golf club head, disclosed below, need not be limiting in any manner. Furthermore, the various aspects and features described below may be used alone or in a variety of novel and nonobvious combinations and subcombinations with one another.

For all purposes herein, the term "reference position" refers to an orientation of a golf club head relative to a virtual ground plane (e.g., virtual ground plane 10 in FIG. 1B) in which a sole portion of the club head rests on the virtual ground plane such that the club head is squared in a normal address position.

Figure 1A:
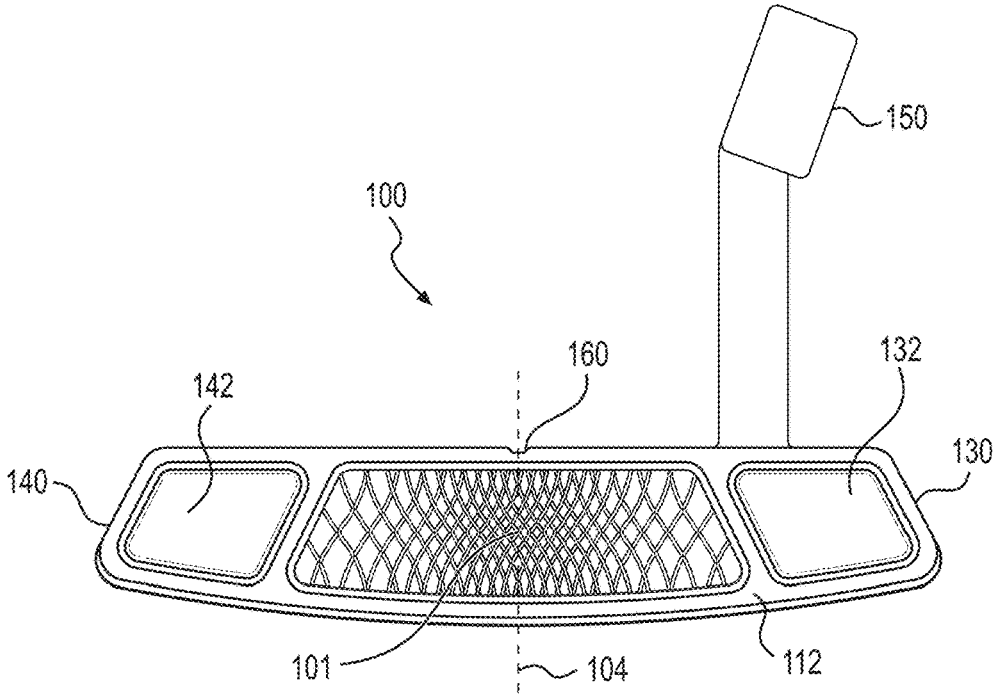
FIG. 1A is a front view of an exemplary putter-type golf club head.
Figure 1B:
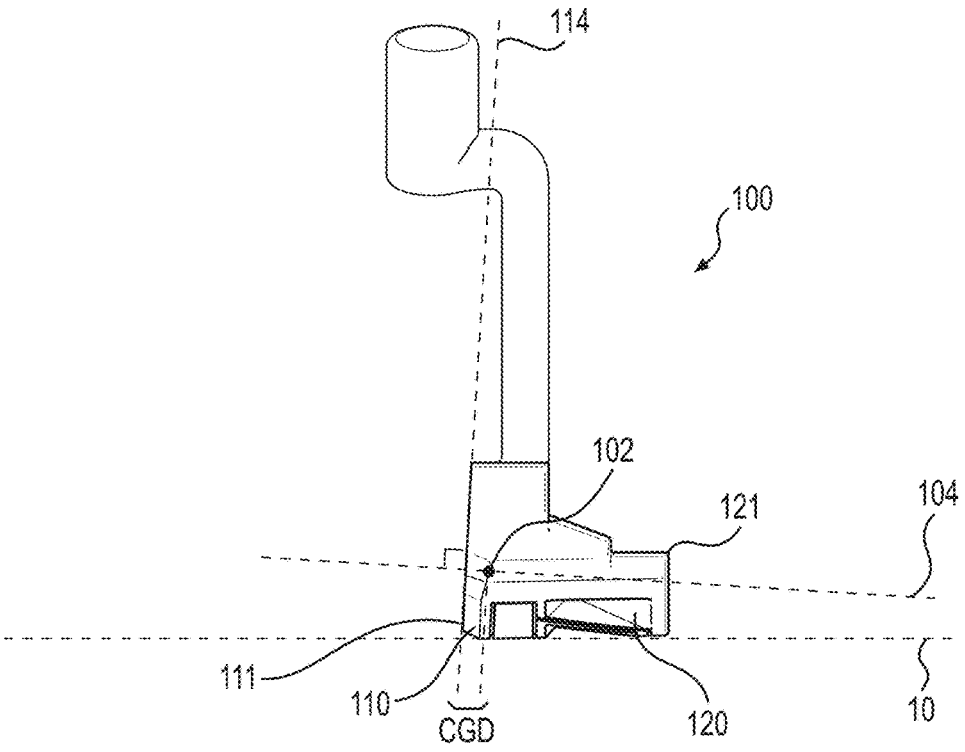
FIG. 1B is a heel side view thereof.

Shown in FIGS. 1A and 1B is a putter-type golf club head 100 having a main body with a front portion 110, a rear portion 120 that extends rearwardly from the front portion 110, a heel 130, and a toe 140. The golf club head 100 includes a hosel 150 configured to be attached to a golf club shaft (not shown). The front portion 110 includes a face 112 that defines a virtual face plane 114. The front portion 110 includes a forwardmost extent 111. The rear portion 120 includes a rearwardmost extent 121. An overall golf club head length. L (see FIG. 2A) is defined as a front to rear distance between the forwardmost extent 111 and the rearwardmost extent 121.

The golf club head 100 has a center of gravity (CG) 102. The CG 102 has a depth CGD, which is measured along a depth axis that passes through the CG 102 and is normal to the face plane 114. Herein, a positive CGD value denotes a golf club head CG located rearward of its virtual face plane, while a negative CGD value denotes a golf club head CG located forward of its virtual face plane. The golf club head 100 includes a weight structure comprising a heel insert 132 and a toe insert 142. The heel insert 132 and the toe insert 142 are received in respective heel and toe recesses of the front portion.

The weight structure resulting from the above-described configuration effectively moves the CG 102 of the golf club 100 toward the face 112 and reduces the golf club head's CGD. As explained in more detail below, alignment of the CG with the virtual face plane minimizes the azimuth angle of a putt's trajectory on off-center strikes, so for shot dispersion purposes, it is advantageous to minimize CGD. As used herein, the term "off-center strike" means any strike in which a surface of the golf ball is not contacted by the face center (e.g., 101) described below.

Figure 8B:
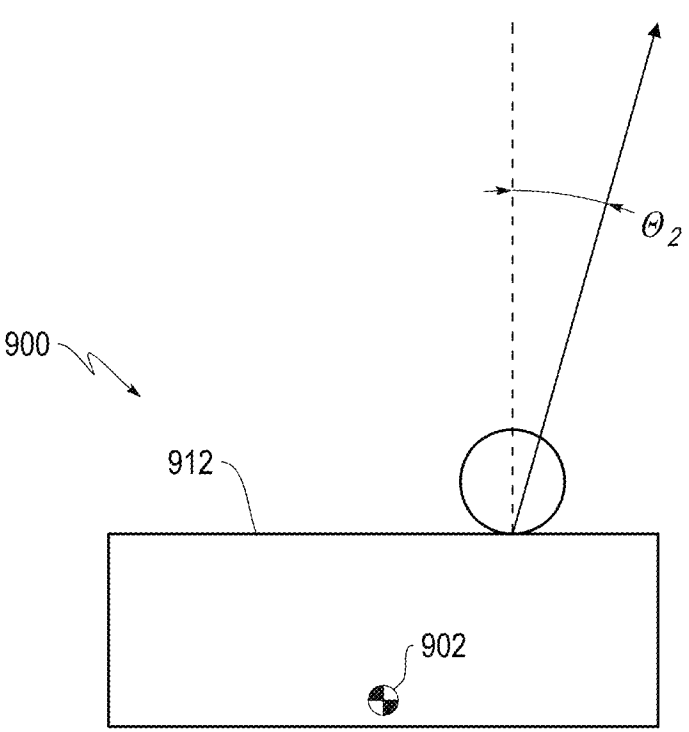
FIG. 8B is a diagram illustrating shot dispersion for a golf club head with a CG located away from its face.
Figure 8A:
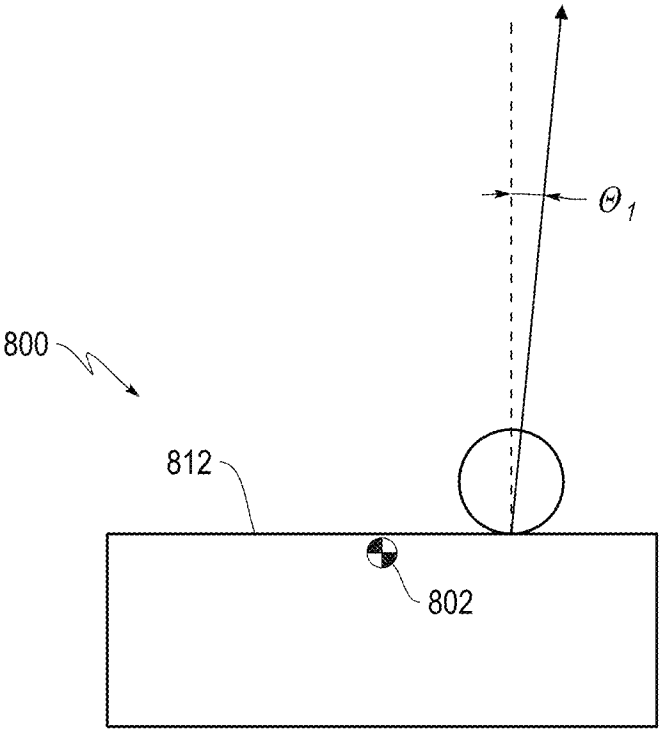
FIG. 8A is a diagram illustrating shot dispersion for a golf club head with a CG located proximate its face.

Through testing, it has been determined that CGD has a significant effect on the azimuth angle of a putt's trajectory. For example, FIGS. 8A and 8B illustrate the role of CG depth in the azimuth angle of a putt's trajectory. Golf club head 800 has a CG 802 located proximate its face 812 while golf club head 900 has a CG 902 away from its face 912. On similarly located off-center strikes, the azimuth angle θ1 from golf club head 800 is much smaller than the azimuth angle θ2 from golf club head 900.

Figure 9A:
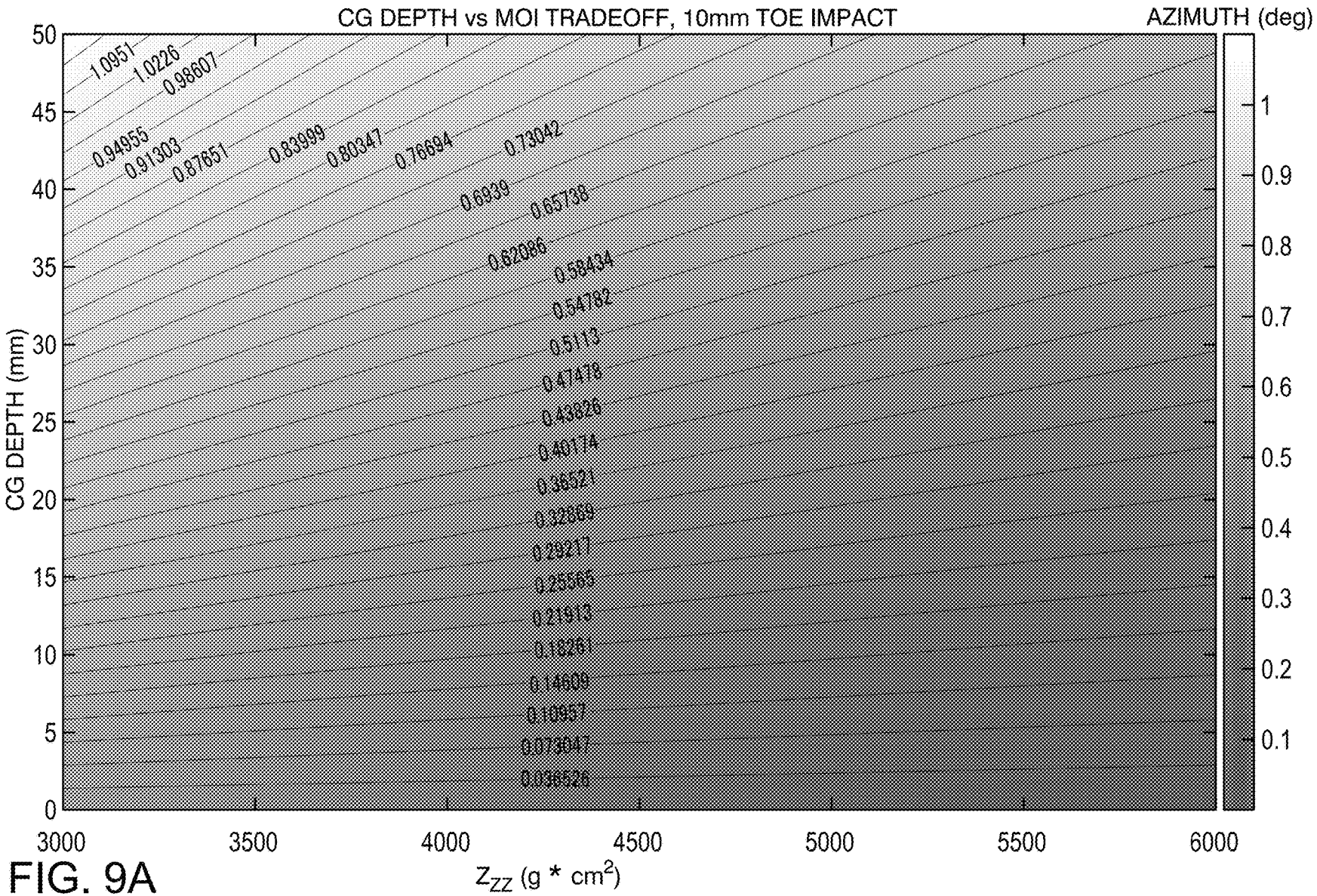
FIG. 9A is a contour plot of azimuth angles on off-center putts for ranges of CG depths and moments of inertia.
Figure 9B:
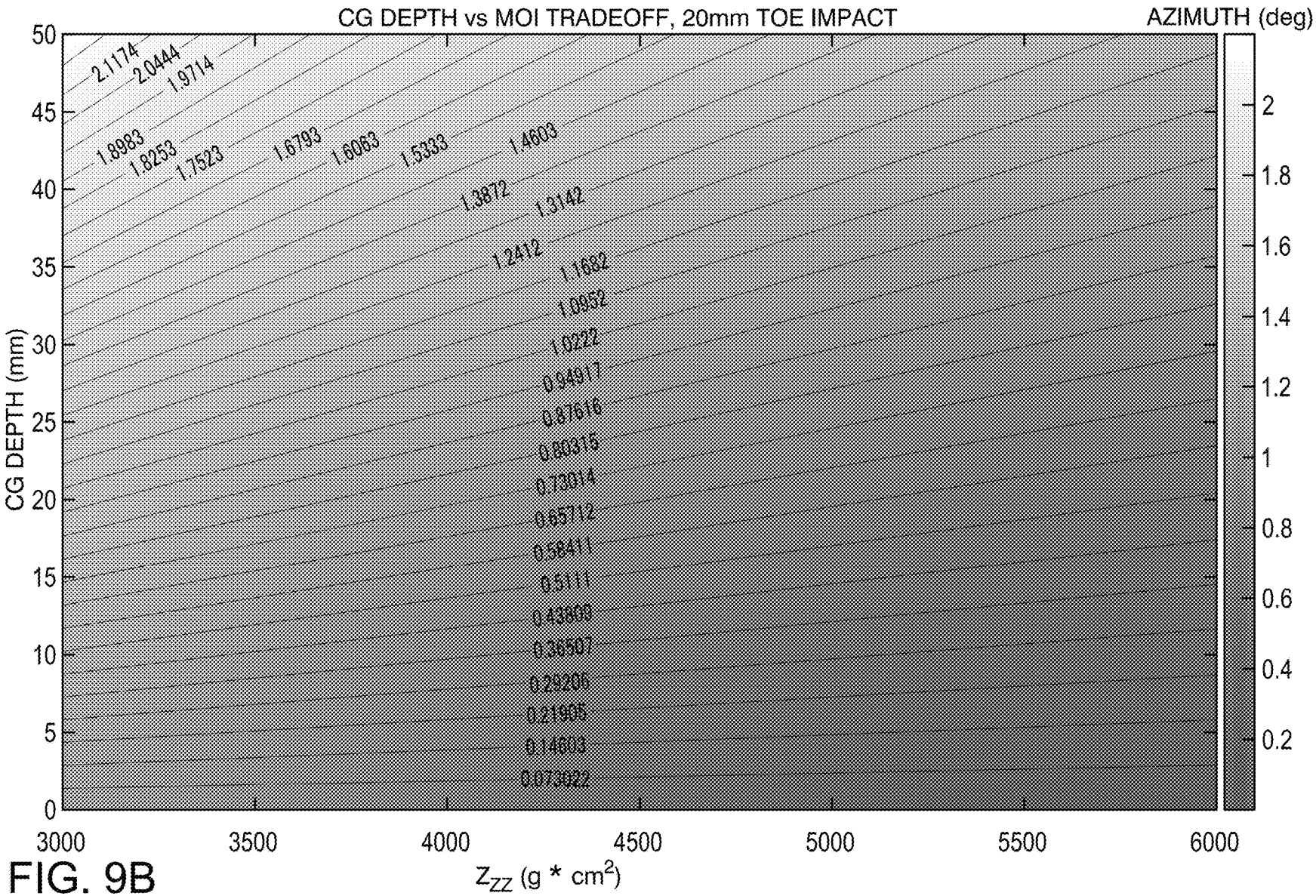
FIG. 9B is another contour plot of azimuth angles on off-center putts for ranges of CG depths and moments of inertia.

The contour plots of FIGS. 9A and 9B illustrate this concept more clearly and relate it to the effect of a golf club head's Izz (MOI about a vertically oriented z-axis) on off-center hits. The plots were generated using a rigid body math model of impulse-momentum balance to simulate ball and club conditions after impact and compare azimuth angles for putts struck 10 mm (FIG. 9A) and 20 mm (FIG. 9B) away from the face center of a golf club head for a range of CGD and a range of Izz. As seen in the plots, azimuth angle is substantially greater on putts hit farther away from the face center. The results show that CGD significantly affects a putt's trajectory. Thus, reducing CGD can be an alternative or supplementary approach to reducing shot dispersion than increasing Izz. This, is because increasing Izz in a putter can be difficult due to constraints from design, manufacturing, cost, or the rules of golf.

Accordingly, it is desirable to keep the CGD as small as possible within the usual design constraints for putters. An effective way to describe the limits on CGD location for a putter is by using a ratio of CGD/L, which describes the distance of the CG from the face relative to the over length L of the club in a front-to-rear direction. As such, based on the testing and modeling described above, it has been determined that a ratio of CGD/L that is no greater than 0.30 is preferable to beneficially reduce the azimuth angel of off-center hits. More preferably, the ratio of CGD/L is no greater than 0.28. According, in one or more embodiments, the ratio of CGD/L is no greater than 0.30, and more preferably, no greater than 0.28.

However, it is also desirable to have a minimum CGD for other functional aspects of a putter-type golf club head. For example, a positive CGD is necessary to introduce gear effect on putts; due to gear effect, back spin can be reduced on a high impact putt, which in turn can improve the putt's roll. Additionally, a positive CGD helps to increase MOI, which, in addition to reducing azimuth angle, reduces ball speed dispersion. With an optimized minimum CGD, a ratio of CGD/L is no less than 0.10. Preferably, the ratio of CGD/L is no less than 0.15. Accordingly, in one or more embodiments, the ratio of CGD/L is no less than 0.10, and preferably no less than 0.15.

Returning to FIGS. 1A and 1B, the golf club head 100 includes a face center 101 through which a vertical center plane 104 that is perpendicular to the face plane 114 passes. Ideally, the vertical center plane passes through the CG 102, However, the vertical center plane 104 may less than 3.0 mm away from the golf club head's CG 102. Preferably, the vertical center plane 104 is less than 1.0 mm away from the golf club head's CG 102. In one or more embodiments, the golf club head 100 includes an alignment element 160 that is substantially aligned with the vertical center plane 104. The alignment element 160 helps a golfer to aim by aiding in visually indicating an ideal impact location of the putter face 112.

Figure 2A:
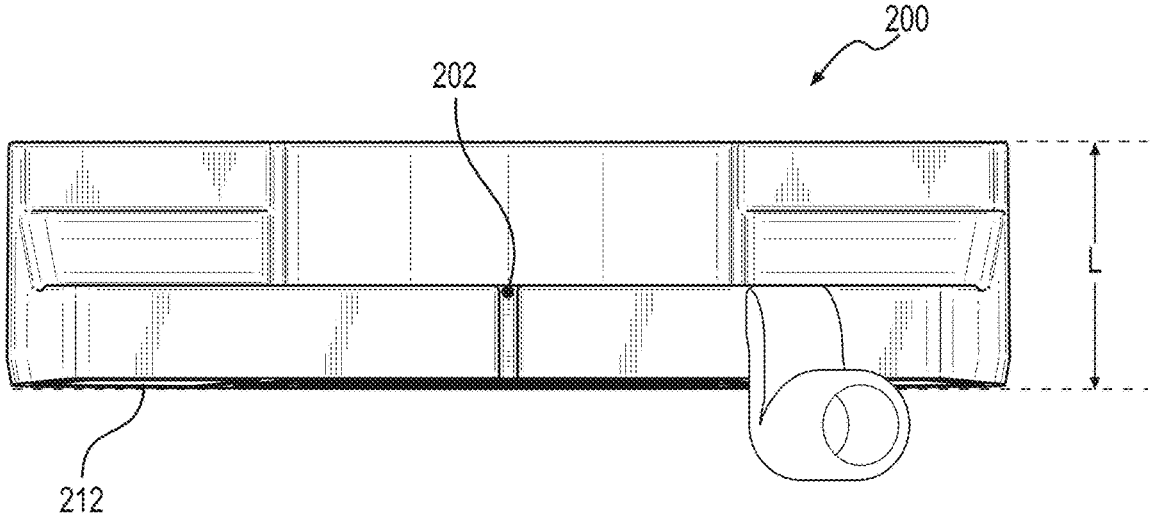
FIG. 2A is top view of an exemplary blade-type putter head.
Figure 2B:
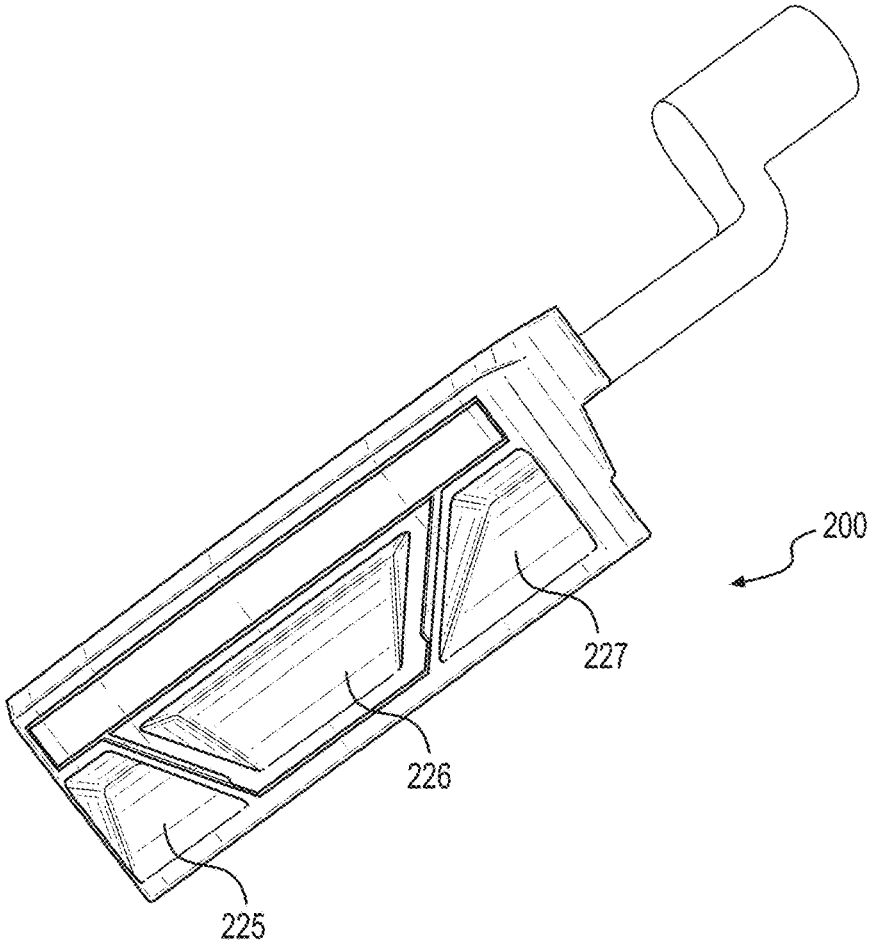
FIG. 2B is a bottom perspective view thereof.

In one or more embodiments, a blade-type putter head 200, shown in FIGS. 2A and 2B, has a CG 202 with a CGD no greater than 10.0 mm. Preferably, the CGD is no greater than 9.0 mm. The golf club head 200 has a length L no greater than 35.0 mm. In a preferred embodiment, the golf club head 200 has a length L less than 30.0 mm. Preferably, a ratio of CGD/L is no greater than 0.30.

The golf club head 200 includes rearwardly positioned weight-reducing features that help to push the CG 202 toward the face 212. For example, the golf club head 200 includes a plurality of sole recesses 225, 226, 227, that remove mass from the rear portion of the putter. To effectively reduce mass, each of the sole recesses has a maximum depth no less than 1.0 mm. Preferably, the maximum depth is no less than 2.5 mm. The blade-type putter head 200 has a main body volume (excluding the volume of any neck or hosel) no greater than 40.0 $cm^3$.

Figure 3A:
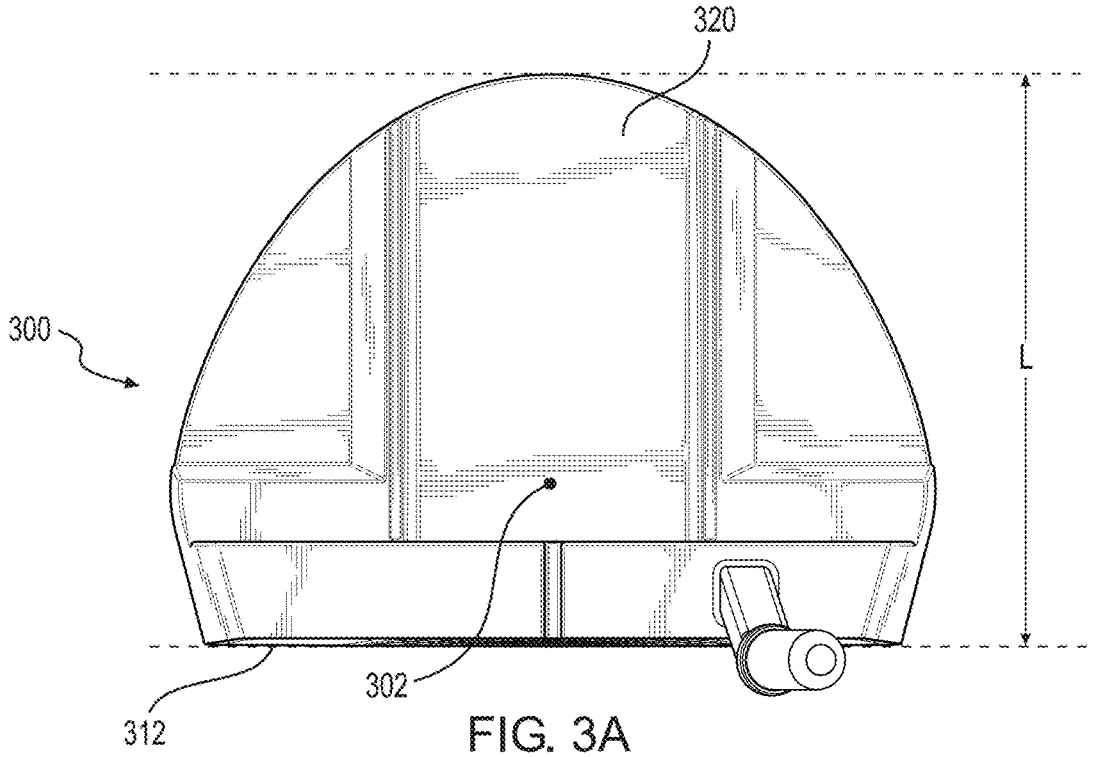
FIG. 3A is a top view of an exemplary mallet-type putter head.
Figure 3B:
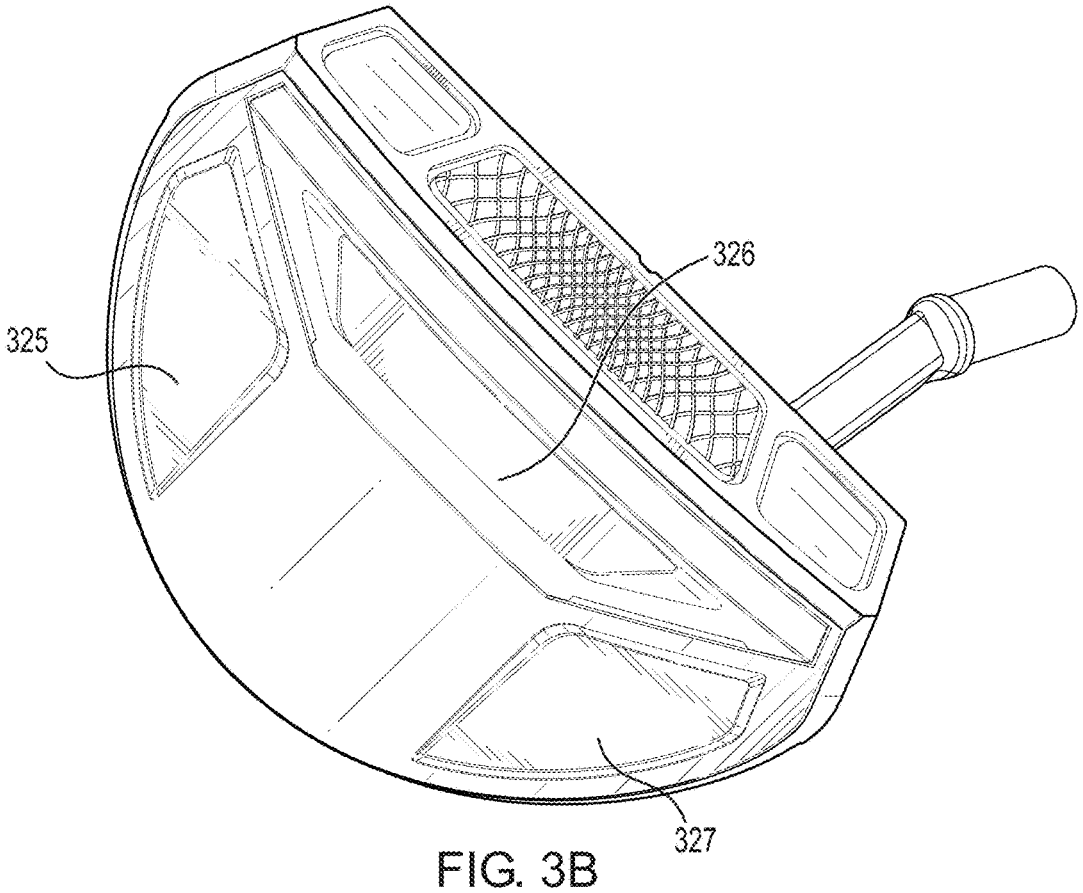
FIG. 3B is a bottom perspective view thereof.

Shown in FIGS. 3A and 3B is a mallet-type putter head 300 having a CG 302. To beneficially affect off-center hits, this style of putter head 300 has a CGD no greater than 25.0 mm. Preferably, the CGD is no greater than 21.0 mm. The golf club head 300 includes a ratio of CGD/L no greater than 0.30. Preferably, the ratio of CGD/L of the golf club head 300 is no greater than 0.27.

The golf club head 300 includes a length L no less than 75.0 mm. The golf club head 300 also includes an overall width measured form a heelward extent to a toeward extent of the golf club head 300 that is greater than L. As such, the exemplary golf club head 300 conforms to USGA dimensional requirements for a putter-type golf club head. The golf club head 300 includes a rearwardly positioned weight-reducing feature that comprises one or more of sole recesses 325, 326, 327 that help to push the CG closer to the face 312. To effectively reduce mass, each of the sole recesses has a maximum depth no less than 1.0 mm. Preferably, the maximum depth is no less than 2.5 mm. The golf club head 300 includes a main body volume no greater than 50.0 $cm^3$. Preferably, the main body volume is no greater than 45.0 $cm^3$.

Figure 4A:
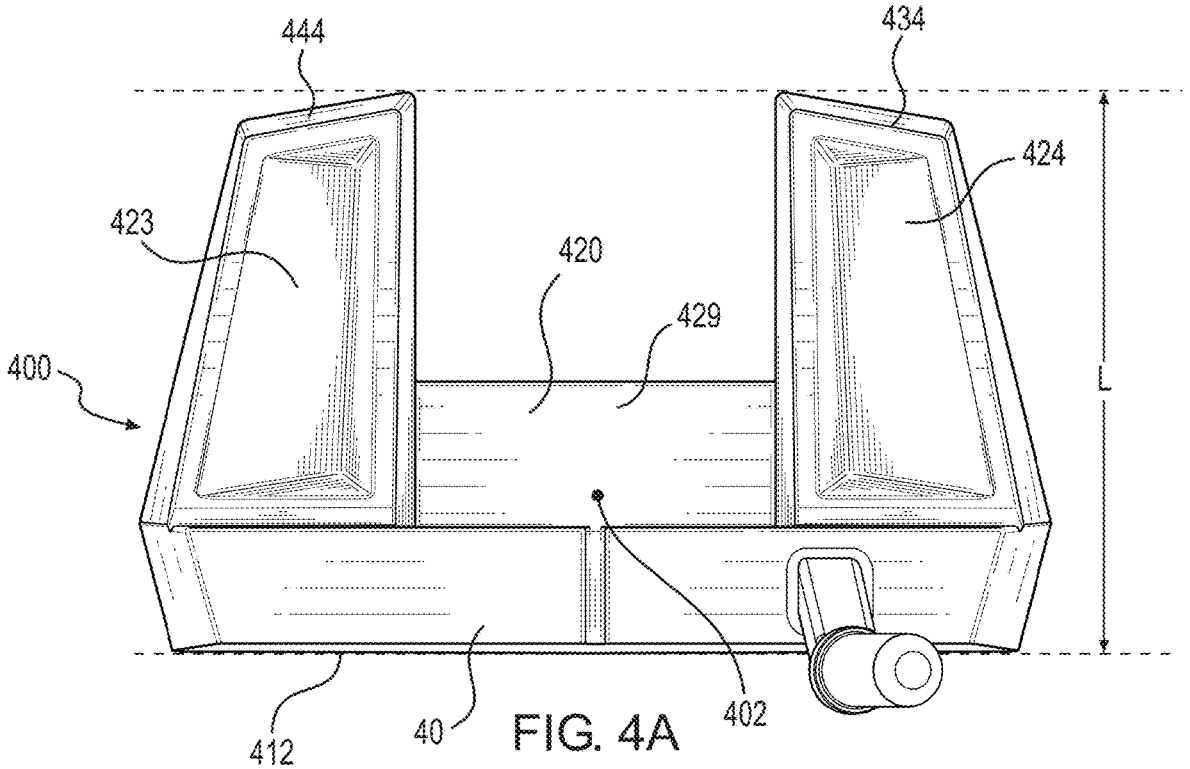
FIG. 4A is a top view of another exemplary mallet-type putter head.
Figure 4B:
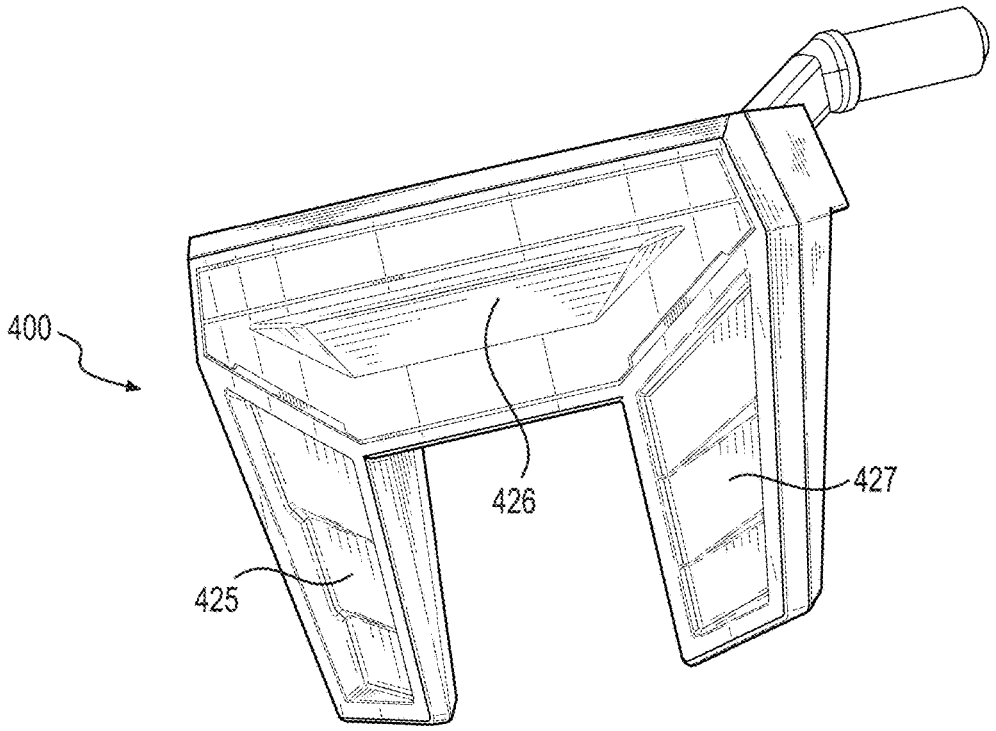
FIG. 4B is a bottom perspective view thereof.

FIGS. 4A and 4B depict another mallet-type putter head 400 that includes a rear portion 420 extending rearwardly from a front portion 410. The rear portion 420 includes a heel projection 434, a toe projection 444, and a central section 429. Each of the heel projection 434 and the toe projection 444 extend more rearwardly than the central section 429 by at least 25.0 mm. Preferably, the heel projection 434 and the toe projection s 444 extend more rearwardly than the central section 429 by at least 30.0 mm.

To beneficially affect off-center hits, this style of putter head 400 includes a CG 402 having a CGD/L ratio no greater than 0.3. The CGD of golf club head 400 is preferably no greater than 17.0 mm.

The putter-type golf club head 400 includes one or more rearwardly positioned weight-reducing features. These features include an upper toe recess 423 and an upper heel recess 424. The weight reducing features may also include sole recesses 425, 426, and 427. Each of the sole recesses 425, 426, and 427 may comprise a plurality of sub-recesses as shown in FIG. 4B. To effectively reduce mass, each of the sole recesses has a maximum depth no less than 1.0 mm. Preferably, the maximum depth is no less than 2.5 mm. The golf club head 400 has a main body volume no greater than 45.0 $cm^3$.

Figure 5A:
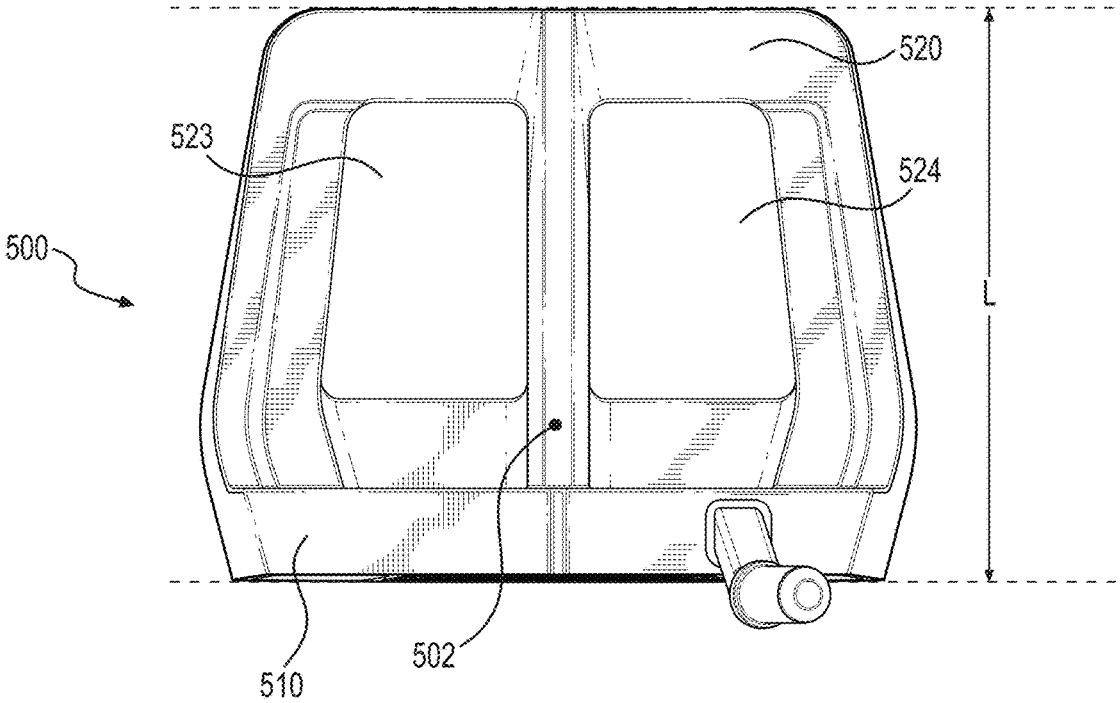
FIG. 5A is a top view of another exemplary mallet-type putter head.
Figure 5B:
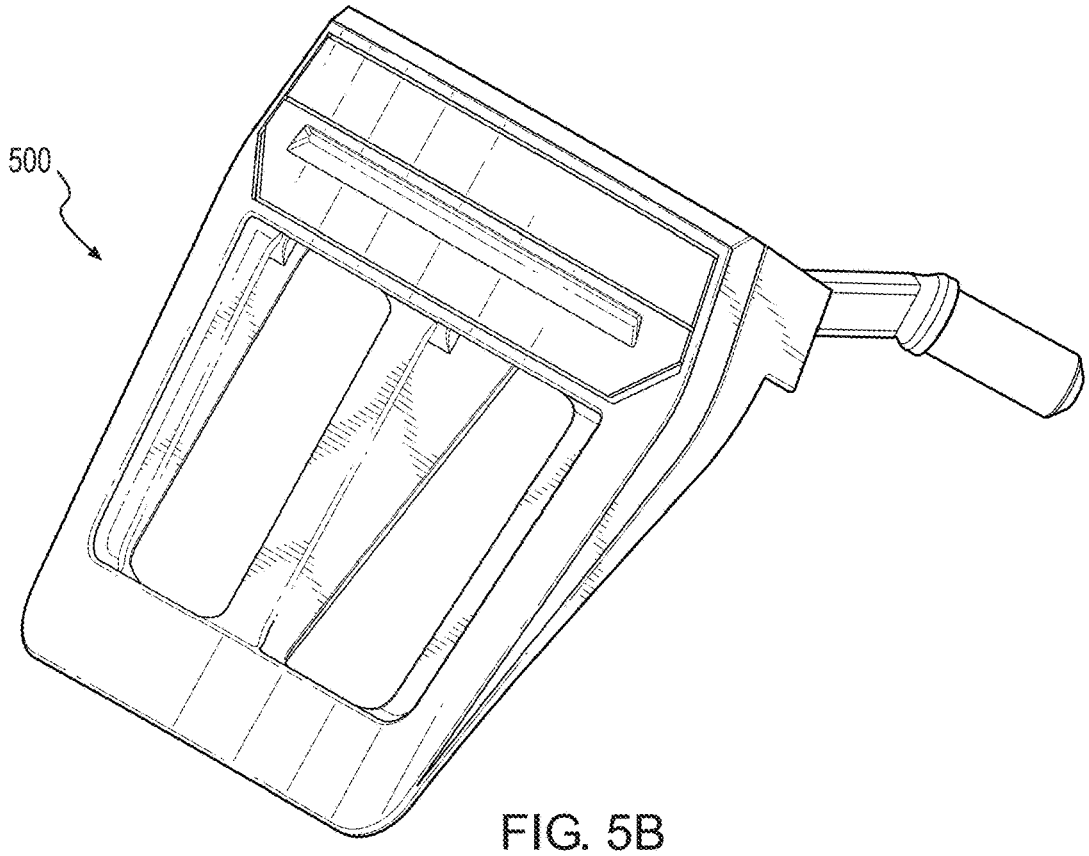
FIG. 5B is a bottom perspective view thereof.

As shown in FIGS. 5A and 5B, another mallet-type putter head 500 includes a front to rear length L of at least 80.0 mm. To beneficially affect off-center hits, this style of putter head 500 has a CG 502 with a depth CGD such that a ratio of CGD/L is no greater than 0.3 and an overall heel to toe width that exceeds L. The CGD/L ratio is preferably no greater than 0.28.

Golf club head 500 includes rearwardly located weight reducing features including a toe-side opening 523 and heel-side opening 524 in a rear portion 520 that extends rearwardly from a front portion 510. To effectively reduce mass in a rear part of the putter, in a preferred embodiment, each of the toe-side opening 523 and heel-side opening 524 have a maximum front to rear dimension that is at least 10.0 mm greater than a maximum heel to toe dimension. The golf club head 500 includes a volume no greater than 50.0 $cm^3$. Preferably, the volume is about 45 $cm^3$.

Mallet-type putter heads, such as those shown in FIGS. 3-5 are preferred by some golfers over blade-type putter heads. However, due to their elongated bodies, mallet-type putter heads often have a CG that is inherently more rearward than blade-type putter heads. Incorporating the forwardly positioned weight structures and rearwardly positioned weight reducing features described above beneficially move the CG closer to the face and thereby reduce CGD in a way that effectively reduces the azimuth angle on off-center strikes.

Figure 6:
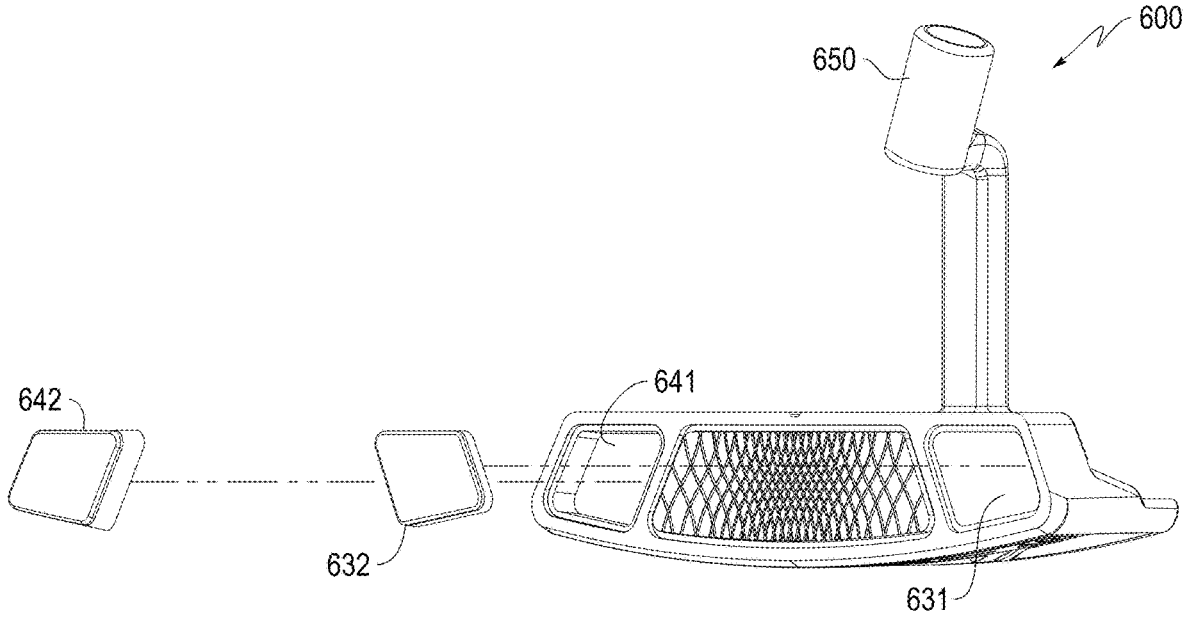
FIG. 6 is an exploded view of another exemplary golf club head.

Shown in FIG. 6 is an exploded view of a putter-type golf club head 600 having a weight structure comprising a heel insert 632 and a toe insert 642 The heel insert 632 has a mass that is greater than a mass of the toe insert 642. This difference in masses of the inserts counters the asymmetric heel-to-toe mass distribution of golf club head 600 due to the neck and hosel 650 extending from the heel side of the golf club head 600 and allows the CG of the golf club head 600 to be laterally centered without making the golf club head 600 appear unevenly weighted.

In blade-type putter head embodiments, the toe insert is at least 20.0 g greater than the heel insert. In mallet-type putter head embodiments, the toe insert is at least 6.0 g greater than the heel insert. These forwardly positioned inserts 632, 642 also act as weights to beneficially move the CG closer to the face and thereby reduce CGD in a way that effectively reduces the azimuth angle on off-center strikes.

A symmetric appearance of a golf club head's main body, e.g., about the vertical center plane 104 of FIG. 1A, can be very beneficial to a golfer. It can help the golfer to visually line up the putt and also to strike the ball about the lateral center of the golf club face.

In order to achieve a symmetric appearance with different masses of heel and toe inserts, each of the heel and toe inserts, according to one or more embodiments, has a forward surface that is preferably parallel or substantially coplanar to a virtual face plane. Each of the forward surfaces has substantially the same area. As shown in FIG. 6, the heel insert 632 has a smaller mass than the toe insert 642 due to a difference in thickness of the inserts. Preferably, the toe insert is at least 3.0 mm thicker than the heel insert. More preferably, the toe insert is at least 3.0 mm thicker than the heel insert. Preferably, the heel insert 632 is received in a heel recess 631 that has a first depth D1 (not shown), and the toe insert 642 is received in a toe recess 641 that has a second depth D2 (not shown) that is greater than D1 to accommodate the thicker insert.

Figure 7:
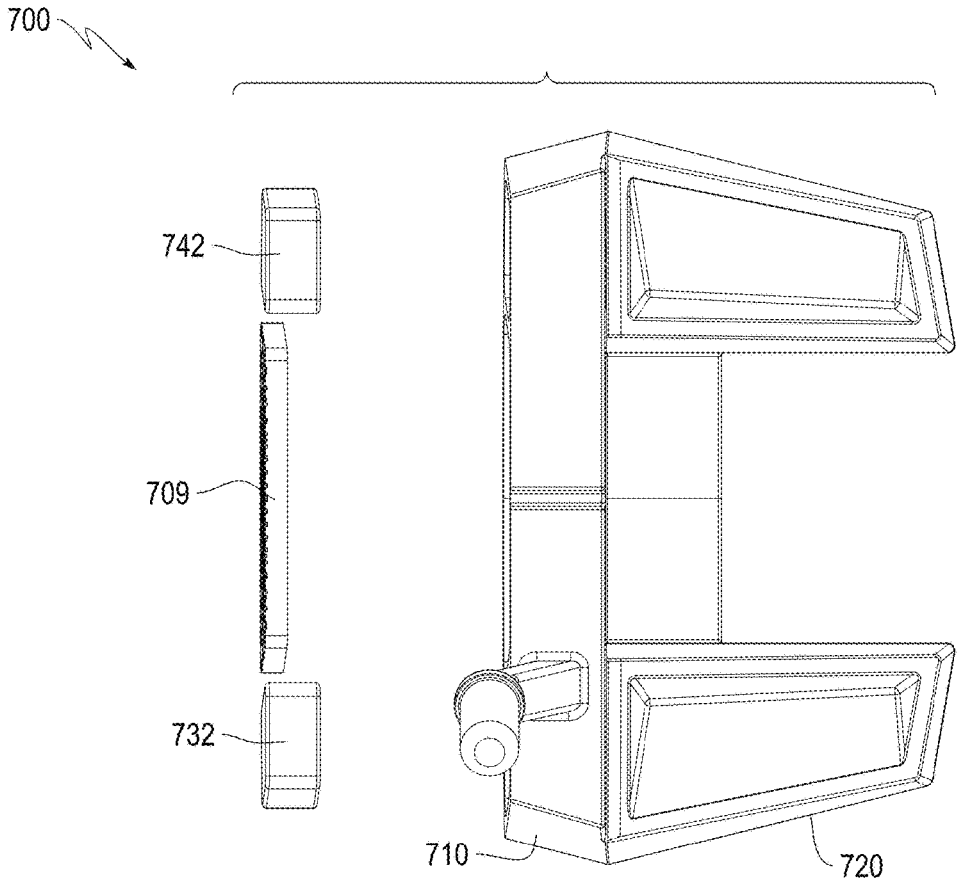
FIG. 7 is an exploded view of another exemplary golf club head.

In another embodiment, as shown in FIG. 7, a golf club head 700 includes a heel insert 732 having a first density and a toe insert 742 having a second density greater than the first density. The heel insert 732 and the toe insert 742 have substantially the same volume, but due to the difference in densities have different masses. To beneficially achieve the appropriate difference in masses to balance the face, the density difference is no less than 4.0 g/$cm^3$. Preferably, the density of the toe insert is no less than 15 g/$cm^3$ and no greater than 20 g/$cm^3$. Preferably, the density of the heel insert is about 12 g/$cm^3$ and the density of the toe insert is about 17 g/$cm^3$.

Importantly, to desirably reduce CGD, forwardly located weight structures, such as the heel and toe inserts described herein, have a density greater than the main body of the golf club head. The difference in densities is preferably at least 4 g/$cm^3$. Further, to desirably reduce CGD, forwardly located weight structures, such as the heel and toe inserts described herein, have a center of gravity that is located rearwardly from the virtual face plane by a distance no more than 1.0 cm.

Further, to desirably reduce CGD, forwardly located weight structures, such as the heel and toe inserts described herein, it is beneficial to control a ratio of a mass relative to the mass of the club head such that:

$$\frac{mw}{mh} \geq R \quad (1)$$

where R is the lower limit (%), mw is the mass of the weight structure (or the combined mass of multiple weight structures), and mh is the mas of the golf club head. Preferably, R is 8.0%. Even more preferably, R is 10%.

According to one or more embodiments, to achieve a beneficial increased mass relative to the material of the golf club head, a weight structure for a putter-type golf club head includes a heel insert and a toe insert, each insert being made of a tungsten nickel alloy. Compositions of the tungsten nickel alloys for the heel insert and the toe insert may be different to provide a denser material for the toe insert.

As shown in FIG. 7, the putter-type golf club head 700 may include a separate central insert 709. The central insert 709 has a density less than that of the toe insert 742 or the heel insert 732. Such an arrangement is beneficial for providing a higher moment of inertial of the golf club head about a vertical axis through the CG, Izz. To beneficially increase the moment of inertia, the central insert 709 has a mass of about 5 g to about 8 g. In one embodiment, the central insert 709 is formed of aluminum and the heel and toe inserts are formed of a tungsten-nickel alloy. For example, the golf club head can have an Izz value of no less than 4000 g*cm$^2$. Preferably, the golf club head can have an Izz value of about 4,200 g*cm$^2$. Additionally, a lower density central insert for impacting a golf ball provides a more traditional and softer feel, which is generally preferred by golfers.

According to one or more embodiments, to beneficially minimize CGD while also beneficially increasing Izz, a blade-type putter head includes a weight structure comprising a toe insert having a mass that is at least 15.0 g greater than a mass of a heel insert. Preferably, the mass difference is about 21 g. Preferably, the toe insert is about 41 g.

According to one or more embodiments, to beneficially minimize CGD while also beneficially increasing Izz a mallet-type putter head includes a weight structure comprising a toe insert having a mass that is at least 4.0 g greater than a mass of a heel insert. Preferably, the mass difference is about 7 g. Preferably, the toe insert is about 23 g.

Figure 11:
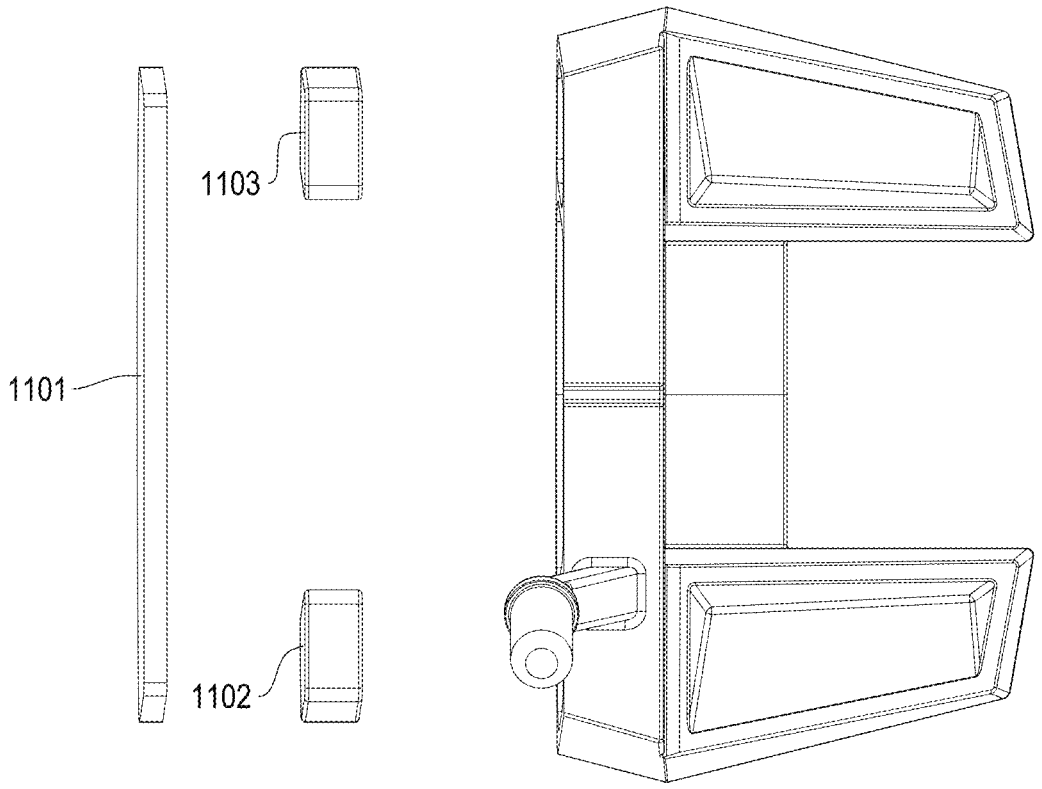
FIG. 11 shows an exploded view of another exemplary golf club head.

In one or more embodiments, the weight insert is located proximate the face plane, but may be obscured from view. For example, a face plate 1101, as shown in FIG. 11, may be positioned so as to conceal a heel 1102 and toe insert 1103.

According to one or more embedment's, the central insert (e.g., 709) or faceplate (e.g., 1101) may have a pattern designed to control ball speed upon impact. In addition to CGD and Izz, ball speed on impact can affect the azimuth of off-center hits, both vertically and horizontally. In particular, it is desirable for ball speed to be equal for both on-center and off-center hits. However, an off-center hit, particularly in lower MOI putter heads, can result in reduced ball speed. Thus, it is desirable to use a pattern on the face of the putter that normalizes ball speed such that the ball speed on a center hit is substantially equal to the ball speed on an off-center hit, no matter where on the face the ball is struck. An example of one such pattern is shown in FIGS. 10A-10C.

Figure 10B:
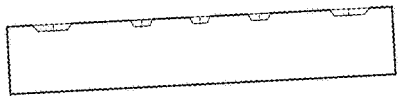
FIGS. 10A-10C show various views of a face according to various embodiments.
Figure 10A:
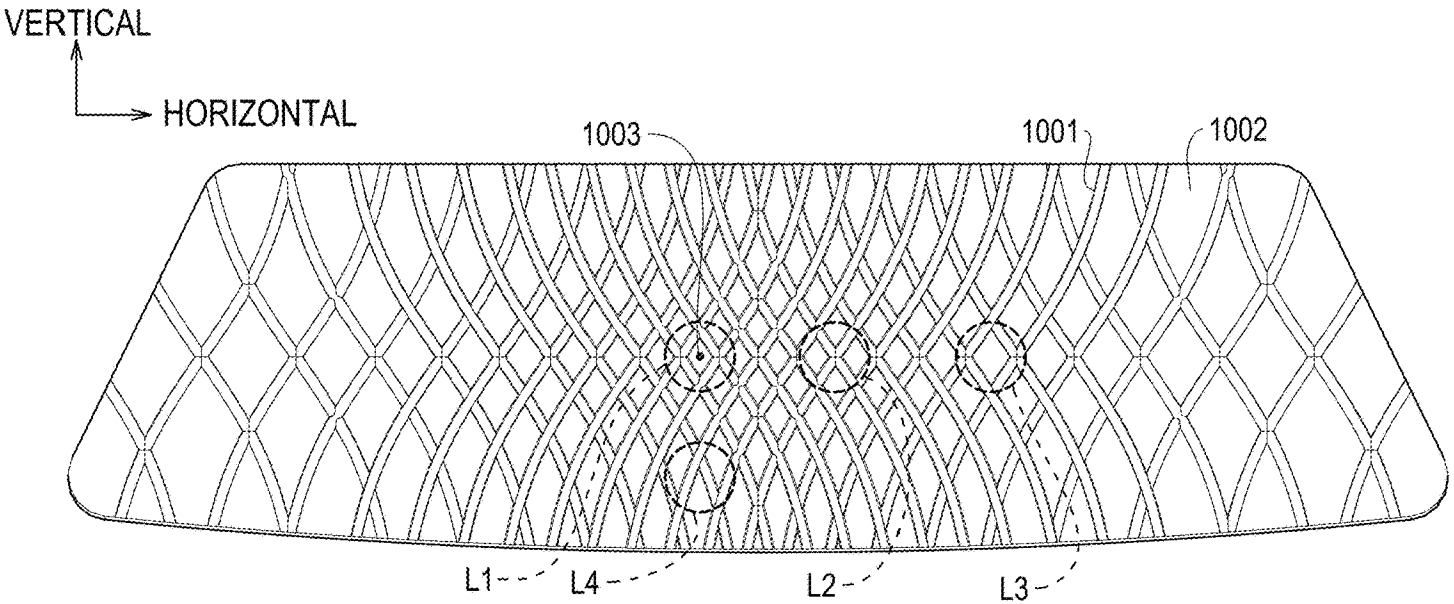
Figure 10C:
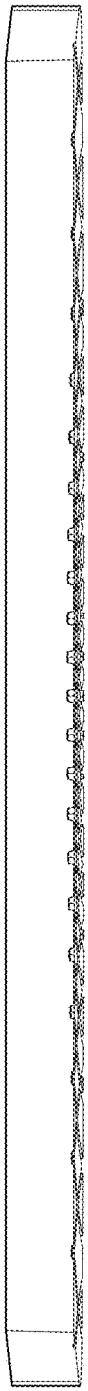

As can be seen in FIGS. 10A-10C, a pattern of grooves 1001 is used to control the amount of striking surface 1002 that is able to contact the ball when impacted. According to the pattern, the amount of striking surface 1002 progressively increases as the distance from the center 1003 of the face increases vertically and/or horizontally. For example, at location L1, which is centered over the face center 1003, the grooves are the densest, and thus the least amount of striking surface 1002 can contact the ball—thereby resulting in the lowest ball speed upon impact. At location L2, which is horizontally off-center, there is more striking surface 1002 that can contact the ball than at location L1—thereby resulting in a higher ball speed upon impact than at location L1. The amount of increase of ball speed at location L2 is substantially the same as the amount of ball speed that will be lost due to the rotation of the club head resulting from impacting the ball at location L2. At location L3, which is even further horizontally off-center than location L2, there is even more striking surface 1002 that can contact the ball than at location L1—thereby resulting in a higher ball speed upon impact than at location L1 or location L2. The amount of increase of ball speed at location L3 relative to location L1 is substantially the same as the amount of ball speed that will be lost due to the rotation of the club head resulting from impacting the ball at location L3. At location. L4, which is vertically off-center, there is more striking surface 1002 that can contact the ball than at location L1—thereby resulting in a higher ball speed upon impact than at location L1. The amount of increase of ball speed at location L4 is substantially the same as the amount of ball speed that will be lost due to the rotation of the club head resulting from impacting the ball at location L4.

The specific location, pattern, depth, and/or width of the groves can be selected to carefully control the amount of striking face that will contact the ball in any one location. For example, to beneficially control the amount of striking face that will contact the ball, it is preferable that the groove depth is no less than 0.1 mm and no more than 0.3 mm. To beneficially control the amount of striking face that will contact the ball, it is preferable that the groove width is 0.62 mm in the plane of the striking face when measured in a heel-toe direction at the vertical center of the face and 0.51 mm in the plane of the striking face in a direction perpendicular to the edges of the groove.

Further, to beneficially control the amount of striking face that will contact the ball, the groove spacing will be depend on the overall geometry and mass distribution of the club head because clubs with different geometries and/or mass distributions (quantified, e.g., by MOI) will have a different amount of rotation for a similarly located off-center hit. For example, for the club head 100 shown in FIGS. 1A and 1B, it is preferable that the grooves have a spacing from the center of one groove to the center of an adjacent groove in the plane of the striking face when measured in a heel-toe direction at the vertical center of the face of no less than 1.75 mm and no more than 4.27 mm, where the spacing progressively increases within this range as the distance from the face center 101 increases. For the club heads 300, 400 shown in FIGS. 3A-4B, it is preferable that the grooves have a spacing from the center of one groove to the center of an adjacent groove in the plane of the striking face when measured in a heel-toe direction at the vertical center of the face of no less than 1.75 mm and no more than 3.71 mm, where the spacing progressively increases within this range as the distance from the face center increases. For the club head 500 shown in FIGS. 5A and 5B, it is preferable that the grooves have a spacing from the center of one groove to the center of an adjacent groove in the plane of the striking face when measured in a heel-toe direction at the vertical center of the face of no less than 1.75 mm and no more than 3.20 mm, where the spacing progressively increases within this range as the distance from the face center increases.

The central insert 709 or face plate 1101 is preferably formed with the above described groove patterns by metal injection molding. However, a striking face having the groove patterns need not be part of a separate face plate or insert. For example, a putter head's main body can comprise such a striking face, and the grooves can be formed on the striking face by milling or etching.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying inventive principles.

We claim:

1. A putter-type golf club head that, when oriented in a reference position, comprises:

a main body including:

a heel;

a toe opposite the heel;

a front portion having a face defining a virtual face plane, the face including a forward-most extent of the front portion;

a rear portion extending rearwardly from the front portion and having a rearward-most extent of the golf club head, the rear portion including:

a heel projection projecting rearwardly from the front portion;

a toe projection projecting rearwardly from the front portion; and a central section between the heel projection and the toe projection, the central section projecting less rearwardly from the front portion than each of the heel projection and the toe projection by at least 30.0 mm; and a sole surface including a plurality of empty sole recesses located entirely rearwardly of a golf club head center of gravity CG, the plurality of empty sole recesses being located in the heel projection and the toe projection, with each of the heel projection and the toe projection containing a sole recess of the plurality of empty sole recesses, each of the plurality of empty sole recesses being in the form of a blind hole and comprising a plurality of sub-recesses arranged in a front to rear direction, at least a portion of each of the plurality of sub-recesses of the plurality of empty sole recesses being located rearward of the central section, and in each of the plurality of empty sole recesses, each sub-recess has a same depth on a side of the sole recess facing toward the central section as the other sub-recesses in that empty sole recess and a different depth on a side of the sole recess facing away from the central section than the other sub-recesses in that empty sole recess;

a weight insert that is denser than the main body and includes an insert CG located rearwardly from the virtual face plane by a distance no more than 1.0 cm;

a CG depth CGD that is measured along a depth axis that passes through the CG and is normal to the virtual face plane, the CGD being no greater than 25.0 mm;

a golf club head length L measured in the front to rear direction from the forward-most extent of the front portion to the rearward-most extent of the rear portion, L being no less than 75.0 mm; and a ratio of CGD/L of no less than 0.15 and at most 0.30.

2. The golf club head of claim 1, wherein:

the face includes a heel side recess and a toe side recess; and the weight insert comprises:

a heel insert received in the heel side recess; and a toe insert received in the toe side recess.

3. The golf club head of claim 2, wherein the heel insert has a first volume and the toe insert has a second volume that is substantially equal to the first volume.

4. The golf club head of claim 2, wherein the heel insert and the toe insert comprise a heel face and a toe face, respectively, that are substantially coplanar with the virtual face plane.

5. The golf club head of claim 2, wherein the face includes a central recess with a central insert received therein, the central recess being located between the heel side recess and the toe side recess.

6. The golf club head of claim 5, wherein the heel insert has a first density, the toe insert has a second density greater than the first density, and the central insert has a third density less than the first density.

7. The golf club head of claim 2, wherein a mass of the heel insert is less than a mass of the toe insert.

8. The golf club head of claim 2, wherein a density of the heel insert is no less than 9 g/cm$^3$, no greater than 15 g/cm$^3$, and less than a density of the toe insert.

9. The golf club head of claim 8, wherein a density of the heel insert is about 12 g/cm$^3$.

10. The golf club head of claim 2, wherein a density of the toe insert is no less than 15 g/cm$^3$ and no greater than 20 g/cm$^3$.

11. The golf club head of claim 1, wherein the weight insert has a mass mw, the golf club head has a mass mh, and:

$$\frac{mw}{mh} \geq 8.0\%.$$

12. The golf club head of claim 11, wherein:

$$\frac{mw}{mh} \geq 10.0\%.$$

13. The golf club head of claim 1, further comprising a moment of inertia about a vertical axis through the CG, Izz, no less than 4000 g*cm$^2$.

14. A putter-type golf club head that, when oriented in a reference position, comprises:

a main body including:

a heel;

a toe opposite the heel;

a face defining a virtual face plane, the face including a heel side recess and a toe side recess;

a main body length L measured in a front to rear direction from a forward-most extent of the main body to a rearward-most extent of the main body, L being no less than 75.0 mm;

a heel projection projecting rearwardly from the face;

a toe projection projecting rearwardly from the face;

a central section between the heel projection and the toe projection, the central section projecting less rearwardly from the face than each of the heel projection and the toe projection by at least 30.0 mm; and a sole surface including a plurality of empty sole recesses located entirely rearwardly of a golf club head center of gravity CG, the plurality of empty sole recesses being located in the heel projection and the toe projection, with each of the heel projection and the toe projection containing a sole recess of the plurality of empty sole recesses, each of the plurality of empty sole recesses being in the form of a blind hole and comprising a plurality of sub-recesses arranged in the front to rear direction, at least a portion of each of the plurality of sub-recesses of the plurality of empty sole recesses being located rearward of the central section, and in each of the plurality of empty sole recesses, each sub-recess has a same depth on a side of the sole recess facing toward the central section as the other sub-recesses in that empty sole recess and a different depth on a side of the sole recess facing away from the central section than the other sub-recesses in that empty sole recess;

a heel insert having a forward surface that is substantially coplanar with the virtual face plane;

a toe insert having a forward surface that is substantially coplanar with the virtual face plane; and a CG depth CGD measured along a depth axis that extends through the CG normal to the virtual face plane, the CGD being no greater than 25.0 mm, and CGD/L being no less than 0.15 and no greater than 0.30.

15. The golf club head of claim 14, wherein the heel insert has a first thickness and the toe insert has a second thickness greater than the first thickness by no less than 3.0 mm.

16. The golf club head of claim 15, wherein the second thickness is greater than the first thickness by no less than 5.0 mm.

17. The golf club head of claim 14, wherein a mass of the heel insert is less than a mass of the toe insert.

18. The golf club head of claim 14, wherein a density of the heel insert is less than a density of the toe insert.

19. The golf club head of claim 18, wherein the density of the toe insert is no less than 15 g/cm$^3$ and no greater than 20 g/cm$^3$.

20. The golf club head of claim 14, wherein the heel insert has a mass m1, the toe insert has a mass m2, the golf club head has a mass mh, and:

$$\frac{m1 + m2}{mh} \geq 8.0\%.$$

* * * * *